US007105738B2

(12) United States Patent
Sim et al.

(10) Patent No.: US 7,105,738 B2
(45) Date of Patent: Sep. 12, 2006

(54) FUNCTIONAL PERFORMANCE OF KEYBOARD MUSICAL INSTRUMENTS

(75) Inventors: Wong Hoo Sim, Singapore (SG); Phoei Min Paul Seow, Singapore (SG); Kok Liang Lim, Singapore (SG)

(73) Assignee: Creative Technology Ltd., (SG)

( * ) Notice: Subject to any disclaimer, the term of this patent is extended or adjusted under 35 U.S.C. 154(b) by 258 days.

(21) Appl. No.: 10/442,758

(22) Filed: May 20, 2003

(65) Prior Publication Data

US 2004/0231501 A1 Nov. 25, 2004

(51) Int. Cl.
*G10H 1/32* (2006.01)

(52) U.S. Cl. ..... 84/719; 84/720; 84/600; 84/744; 84/745

(58) Field of Classification Search ..... 84/600, 84/615, 626–633, 718–720, 737, 739–745, 84/645
See application file for complete search history.

(56) References Cited

U.S. PATENT DOCUMENTS 5,088,378 A * 2/1992 DeLaTorre ..... 84/470 R
6,066,795 A * 5/2000 Hara ..... 84/645
6,420,641 B1 * 7/2002 Kuan ..... 84/658

* cited by examiner

*Primary Examiner*—Marlon Fletcher
(74) *Attorney, Agent, or Firm*—Blakely, Sokoloff, Taylor & Zafman; Stephen M. De Klerk

(57) ABSTRACT

A musical keyboard having associated therewith a alphanumeric keyboard having a plurality of alphanumeric keys, the musical keyboard having a musical keys each being for producing a musical sound, and music function keys for producing musical effects, At least one of the alphanumeric keys is able to be used to modify a result of one or more of the music function keys and musical keys. The music function keys have functionality to produce the musical effect. The modification is only affective while the alphanumeric key is pressed after the musical function key has been pressed. The modification is to change the musical sound produced by the musical keys, and a further modification can be effected by relatively rapid hits of the one key of the plurality of alphanumeric keys. A method is also disclosed.

26 Claims, 4 Drawing Sheets

FUNCTIONAL PERFORMANCE OF KEYBOARD MUSICAL INSTRUMENTS

FIELD OF THE INVENTION

The present invention relates to functional performance of keyboard musical instruments and refers particularly, through not exclusively, to keyboard functions to enable use of musical aspects such as, for example, trills, instrumental sounds, and so forth, by use of an alphanumeric keyboard associated with the keyboard musical instrument.

DEFINITIONS

Throughout this specification reference to "alphanumeric" is to be taken as including any symbols that may be found on the keys of a computer keyboard including regional or national alphabets, scripts and symbols. For example, a so-called "western" keyboard may include the following alphanumeric keys:

- alpha keys a to z;
- numeric keys 0 to 9;
- function keys including dedicated function keys such as, for example, F1 to F12, and such keys as Internet access keys;
- instructional keys such as, for example, "Esc", "Enter", "Ctl", "Shift", "Tab", "Caps Lock", "Delete", "Insert", "Home", "Page Up", "Page Down", "End", "Num Lock";
- cursor control keys;
- and the "Shift" function of all of them.

BACKGROUND TO THE INVENTION

In our earlier international application PCT/SG01/00040 ("our earlier application") there is shown and described a combined keyboard having a fully functional alphanumeric keyboard and a fully functional keyboard for a musical instrument, the musical keyboard preferably being a MIDI keyboard. The contents of our earlier application are hereby incorporated by reference.

The number of selections available by pressing any key on a alphanumeric keyboard is limited, as there are only 104 keys on the keyboard. It is possible to use another key such as CTRL or ALT together so that the keyboard can handle more selections. However, when speed is of essence, it is sometimes not possible to press CTRL followed by any other key.

For someone who uses a alphanumeric keyboard frequently, such as during music making, a convenient and fast method for interaction to provide a speedy operation is required.

A trill happens when two music notes, normally adjacent notes, are played alternately at high speed, producing a vibrating effect on the sound. This effect is very difficult to reproduce, as it requires speed of playing on the one or two notes.

Some MIDI keyboards implement this feature by adapting every key on the MIDI keyboard to play trills after a particular, designated function button is activated. However, this is often not intended in music playing. A user may only want certain selected keys to play trills, and only for selected notes during the performance. This presently requires the particular function key to be activated for each note, and deactivated immediately afterwards. No other note can be played at the same time.

SUMMARY OF THE INVENTION

In accordance with a first aspect of the invention there is provided a musical keyboard having associated therewith a alphanumeric keyboard having a plurality of alphanumeric keys, the musical keyboard having a plurality of musical keys each being for producing a musical sound, and at least one music function key for producing a musical effect, and wherein at least one of the alphanumeric keys is able to be used to modify a result of one or more of the at least one music function key and the plurality of musical keys.

The modification may be of the at least one music function key the at least one music function key having functionality to produce the musical effect. The musical effect may be trill, tremolo, or vibrato, and the modification may be pitch and/or speed.

Preferably, the modification is only effective while the at least one alphanumeric key is pressed after the at least one music function key has been pressed.

Alternatively, the modification may be of at least one of the plurality of musical keys and may be to change the musical sound produced by at least one of the musical keys, the change being to that of a first musical instrument. A further modification may be effected by a plurality of relatively rapid hits of the one key of the plurality of alphanumeric keys. The plurality of relatively rapid hits may be two in number.

The invention also provides a method for use of a alphanumeric keyboard to modify the sound produced by an operation of a musical keyboard, the alphanumeric keyboard being associated with the musical keyboard, the musical keyboard having at least one music function key for producing a musical effect, the method including steps of: upon the pressing of at least one of the plurality of musical keys of the musical keyboard or at least one music function key, pressing at least once a desired one of the alphanumeric keys to modify the musical sound produced.

The modification may be of the at least one music function key, the at least one music function in key having functionality to produce the musical effect. The musical effect may be trill, tremolo, or vibrato; and the modification may be to pitch and/or speed.

Preferably, the modification is only affective while the at least one alphanumeric key is pressed after the at least one music function key has been pressed.

The modification may be of at least one of the plurality of musical keys to change the musical sound produced by at least one of the musical keys. The change may be to that of a first musical instrument; and a further modification can be effected by a plurality of relatively rapid hits of the one key of the plurality of alphanumeric keys to change the musical sound produced by the at least one of the musical keys to that of a second musical instrument. The plurality of relatively rapid hits may be two in number.

The modification may be both of the at least one music function key and at least one of the plurality of musical keys, the at least one music function key having functionality to produce the musical effect.

DESCRIPTION OF THE DRAWINGS

In order that the invention may be readily understood and put into practical effect, there shall now be described by way of non-limitative example only preferred embodiments of the present invention, the description being with reference to the accompanying illustrative drawings, in which.

DESCRIPTION OF PREFERRED EMBODIMENTS

Figure 1:
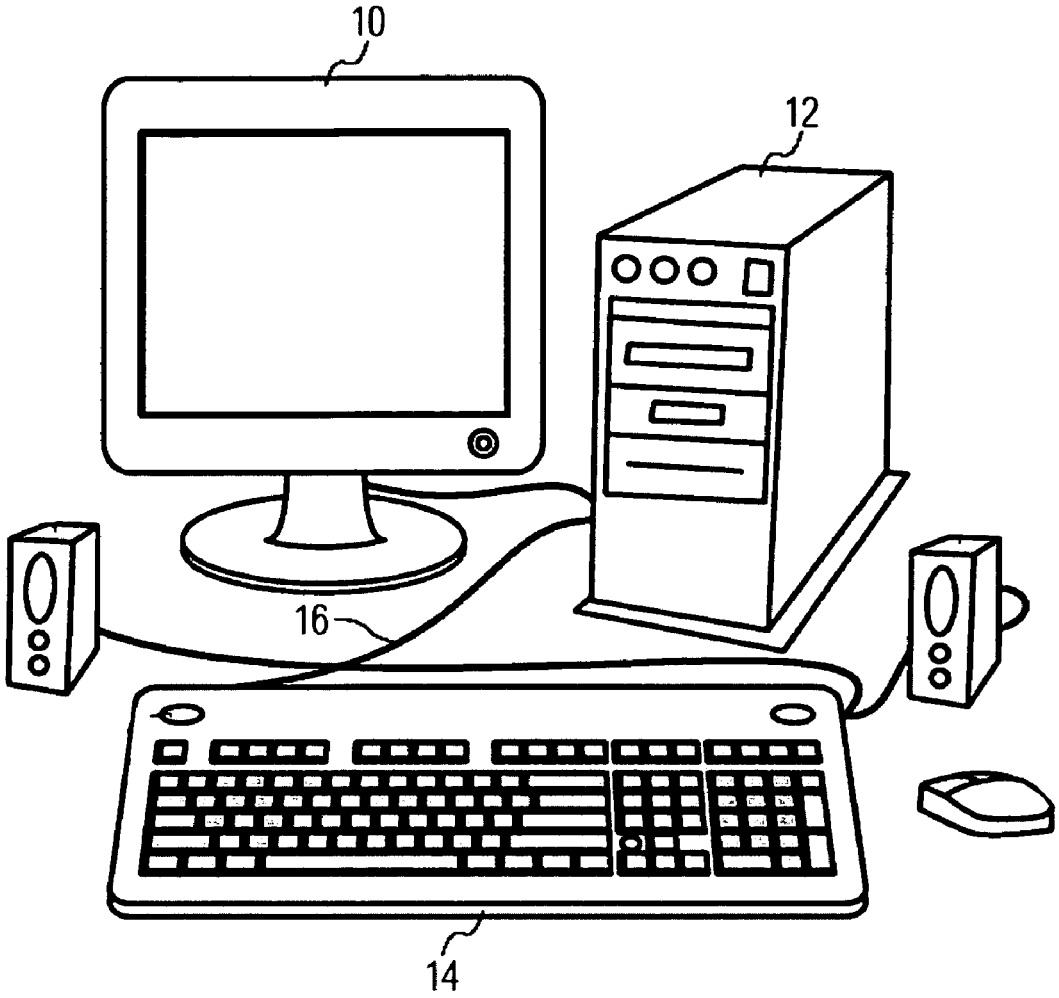
FIG. 1 is a schematic illustration of a computer system using the present invention.

To first refer to FIG. 1, there is shown a computer system including monitor 10, host PC 12 and QWERTY keyboard 14. Keyboard 14 is shown connected to host PC 12 by a cable 16. Alternatively, a wireless connection may be used. The wireless connection may be by any suitable system including, for example, Bluetooth, or any other radio frequency or infrared system.

Cable 16 is connected to keyboard 14 at one end, and has its other end at least one digital data connector. It is preferred to be only one connector. The connector may be a USB connector or a IEEE 1394 connector, or other suitable digital data transfer connector. In the following description reference will be made to the use of a single USB connector for the sake of convenience. However, there may be two connectors with one connector being for "normal" keyboard functions, and a second connector being for digital audio transfer.

Figure 2:
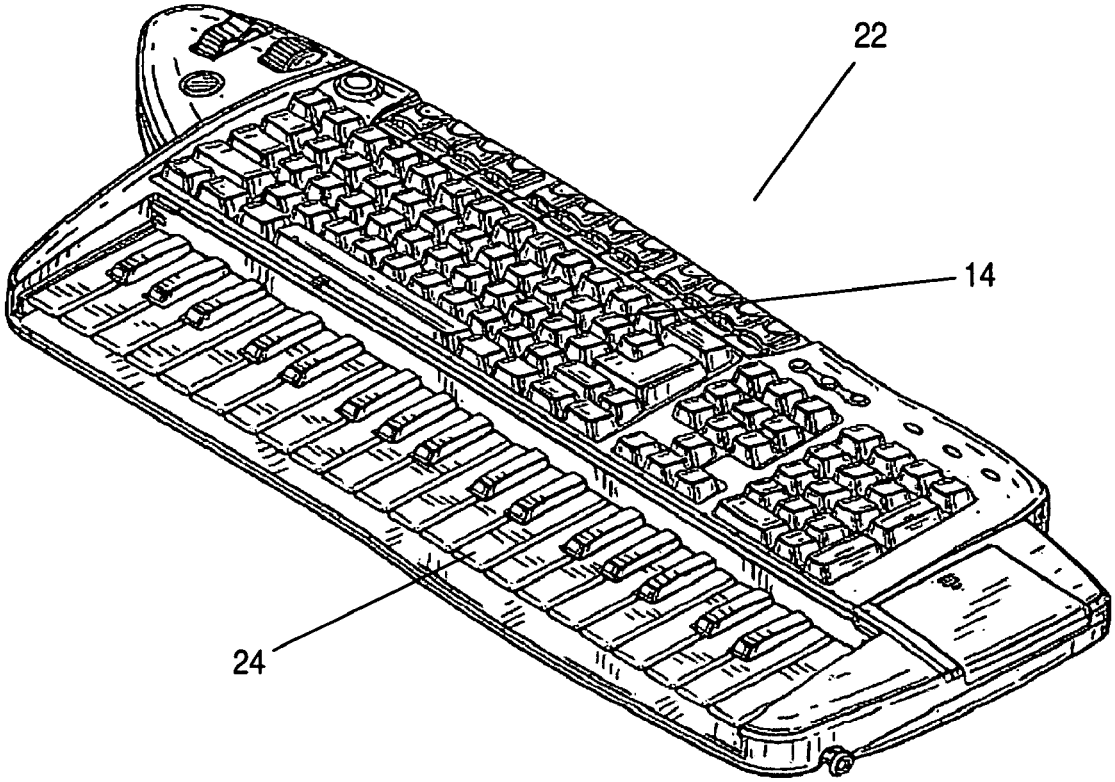
FIG. 2 is a schematic illustration of the keyboard of FIG. 1 with an integrated music keyboard.

The keyboard 14 may be as shown in FIG. 2—a keyboard 22 having a musical keyboard 24 built-in and integrated with the alphanumeric keyboard 14. This may be in accordance with our earlier application number PCT/SG01/00040, the contents of which are hereby incorporated by reference.

Although MIDI is used, it may also be used for a quasi-MIDI musical keyboard, or any other musical keyboard, or any other musical keyboard operating system.

Figure 3:
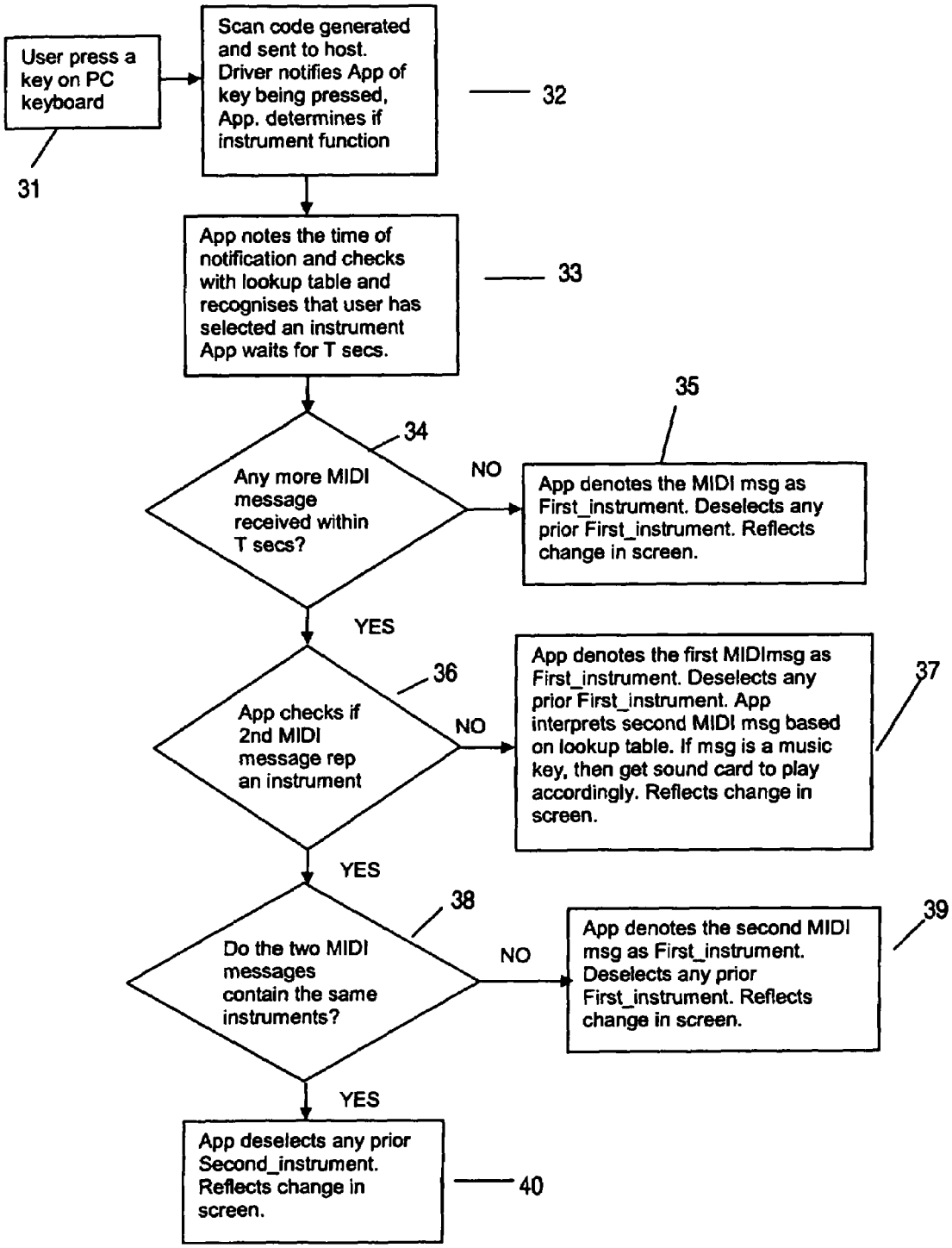
FIG. 3 is a flow chart illustrating a first aspect of the present invention.

To first refer to FIG. 3, there is shown a process whereby pressing the same key of alphanumeric keyboard 14 (either using the hand or an input device) in a short interval triggers a predefined event. This is similar to using a mouse to "double click". For example, if "q" key of a alphanumeric keyboard associated with the musical instrument keyboard is used to trigger a musical output, "double-hitting" it will trigger a different musical output. This operation may be used to select or unselect a second music instrument for melody playing. In this way, once a user selects the functionality for a different sound to be produced, different keys on the associated alphanumeric keys may be used for different sounds. The functionality may be selected by merely using the relevant alphanumeric key.

In step 31, a user presses a single key on the alphanumeric keyboard associated with the musical keyboard. A scan code is generated and sent to the host. The host may be built in the keyboard, or may be a PC, laptop, or the like. A driver in the host notifies the application controlling the musical keyboard functionality of the key being pressed once only (step 32). Upon receipt of the scan code the application determines if the scan code represents an instrument sound function. If not, it passes the signal to the next application. If it is, it continues to the next step in box 33.

In step 33, the application notes the time of the notification and checks a lookup table of keys of the alphanumeric keyboard and associated musical sounds to be produced when the relevant alphanumeric key is pressed, and whether is for a single press or a double press. It assumes that a double press will happen very quickly—normally the second press is within a fraction of a second of the first press. However, in certain circumstances there may be a gap between the first and second presses. Therefore, after checking the lookup table, the application waits a predetermined time such as, for example, (0.1, 0.5, 1.0, 2.0, 3.5, 5.0, 6.7, 10, 20, 30, 40, 50 or 60) seconds. The wait will be determined by the circumstances, and may be by user input. In normal use, it will be a short interval such that to a user it appears instantaneous.

Normally, the sound to be produced will approximate that of a designated musical instrument such as, for example: cornet, trumpet, french horn, trombone, flugel horn, tuba, clarinet, bassoon, contrabassoon, piccolo, flute, oboe, car anglais, saxophone (soprano, alto, tenor or baritone), violin, viola, cello, doublebass, timpani, triangle, xylophone, tambourine, vibraphone, marimba, chimes, glockenspiel, tubular bells, pipe organ, celeste, acoustic guitar, electric guitar, bass guitar; or any muted version of any of them including, but not limited to, straight mute, cup mute, harmon mute, wow-wow mute, and so forth. The sound is not limited to musical instruments and may include sound effects such as, for example, the sound of a speeding train, a bomb exploding, a whistle, a train whistle, a truck horn, whip, bells, cannon, thunder, gunfire, or so forth. All are contained within the use of "musical instrument".

If no more MIDI messages are received within the predetermined time (step 34) the application (step 35) denotes the MIDI message as being for a first instrument and deselects any prior first instrument. This is reflected on the display screen of the musical keyboard. The sound produced by the playing of the music keyboard will therefore be that of the (new) first instrument.

If the result of step 34 is yes, the application checks if the second MIDI message represents an instrument. If not, the same process is performed in step 37 as in step 35, with the additional process of checking the second MIDI message to determine if it is a music key of the music keyboard. If it is, a sound card is instructed to play the relevant note. If not it may be for a different function such as, for example, vibrato, tremolo, and so forth. The sound of the first instrument selected by the first pressing is therefore played in accordance with the second MIDI message.

If the result of step 36 is that the second MIDI message is for an instrument, in step 38 it is checked if the instrument is the same as that for the first MIDI message. If not, the application denotes the second MIDI message as the first instrument and deselect any prior first instrument. This is reflected in the display on the keyboard musical instrument. If the second instrument is the same as the first instrument, the second instrument is deselected (40) and the application continues with the selected first instrument.

In this way a user can use a single key on the alphanumeric keyboard for two different instruments. For example: the key can be pressed once for flute, or pressed twice in a relatively short time (e.g. like a double click) for piccolo. This may be extended to three, four and so forth, hits for third, fourth, and so forth, musical sounds to be produced. The sounds for a single key may be related. For example, one key for flute and piccolo. Another for trumpet and trombone and so forth. Or they may be different: trumpet and flute; bells and thunder; and so forth.

Figure 4:
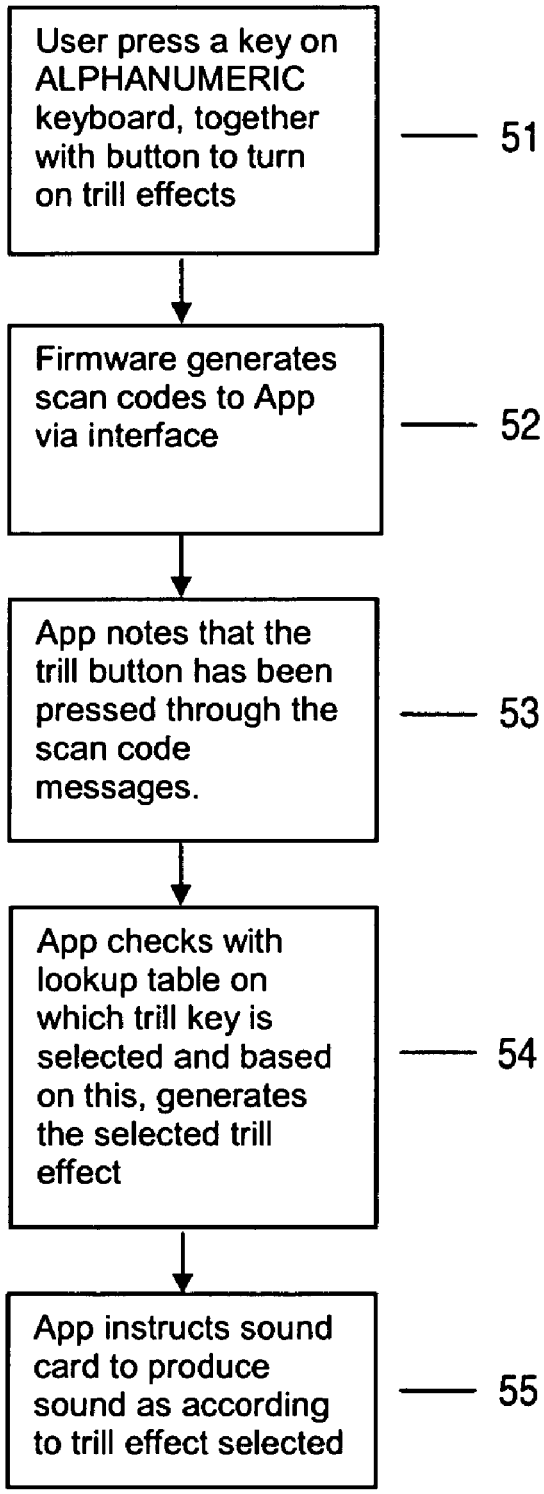
FIG. 4 is a flow chart illustrating a second aspect of the present invention.

To now refer to FIG. 4, there is shown a different functionality given to the alphanumeric keyboard associated with the musical keyboard.

Here, in step 51, the user presses a selected key of the alphanumeric keyboard together with a function key such as a button on the musical keyboard, a function key on the alphanumeric keyboard, or a function button on the musical keyboard. The function may be any relevant musical function such as, for example, trill, tremolo, vibrato, turn, grace notes, and so forth. The example given is for a trill.

The alphanumeric keyboard is to activate and control the musical function selected. For example, a particular alphanumeric may be used if the trill is to the next note (e.g. C to D), a different alphanumeric key if it is to a flat of the next note (e.g. C to Db), or to a sharp of the fundamental note (e.g. C to C#), and other keys for slow, fast, and so forth. This may be achieved by use of multiple hits of the one key, or use of nearby keys pressed simultaneously. For tremolo, similar effects can be generated. For vibrato, it may be for slow, medium, fast vibrator, a slow and accelerating vibrato, and so forth.

In step 52, the firmware generates scan codes to the application via an appropriate interface. The application notes that the trill button has been pressed/activated through the scan code messages (step 53). The application then checks with a lookup table on which alphanumeric key has been pressed to control or modify the trill function. The lookup table contains all relevant possibilities such as those mentioned above. In response to the result of the lookup table, the application generates the selected trill effect (step 54), and instructs a sound card to produce the selected trill effect (step 55). The trill effect is maintained only as long as the alphanumeric key is pressed. Therefore, a user can introduce a trill when and as required by simply pressing the required alphanumeric key. This may be after the musical keyboard key has been pressed. In this way the user can determine the trill function quite early and only apply it when and as required by pressing the relevant alphanumeric key.

If desired, there may be a separate function key to enable and disable the musical effect, the musical effect being activated only upon the relevant alphanumeric key being pressed.

The present invention also extends to a computer useable medium comprising a computer program code that is configured to cause a processor to execute one or more of the functions described above; and to a keyboard, preferably with a host, when so programmed.

By "associated" for the alphanumeric keyboard, it is meant the alphanumeric keyboard and the musical keyboard are integrated, as in our earlier application; or otherwise closely linked such that they can be simultaneously operated by a user.

Whilst there has been described in the foregoing description preferred embodiments of the present invention, it will be understood by those skilled in the technology concerned that many variations or modifications in details of operation, design and/or instruction may be made without departing from the present invention.

What is claimed:

1. A musical keyboard having associated therewith a alphanumeric keyboard having a plurality of alphanumeric keys, the musical keyboard having a plurality of musical keys each being for producing a musical sound, and at least one music function key for producing a musical effect, and wherein at least one of the alphanumeric keys, upon pressing, modifies a result of one or more of the at least one music function key and the plurality of musical keys, and with a further modification effected by a plurality of relatively rapid hits of the one key of the plurality of alphanumeric keys.

2. A musical keyboard as claimed in claim 1, wherein the modification is of the at least one music function key, the at least one music function key having functionality to produce the musical effect.

3. A musical keyboard as claimed in claim 2, wherein the musical effect is selected from the group consisting of: trill, tremolo, and vibrato.

4. A musical keyboard as claimed in claim 3, wherein the modification is selected from the group consisting of: pitch and speed.

5. A musical keyboard as claimed in claim 3, wherein the modification is only effective while the at least one alphanumeric key is pressed after the at least one music function key has been pressed.

6. A musical keyboard as claimed in claim 1, wherein the modification is to change the musical sound produced by at least one of the musical keys, the change being to that of a first musical instrument.

7. A musical keyboard as claimed in claim 1, where the plurality of relatively rapid hits is two in number.

8. A musical keyboard as claimed in claim 1, wherein the further modification is to change the musical sound produced by the at least one of the musical keys to that of a second musical instrument.

9. A method for use of a QWERTY keyboard to modify the sound produced by an operation of a musical keyboard, the QWERTY keyboard being associated with the musical keyboard, the musical keyboard having at least one music function key for producing a musical effect, the method including: upon the pressing of at least one of the plurality of musical keys of the musical keyboard or at least one music function key, pressing at least once a desired one of the QWERTY keys to modify the musical sound produced, wherein the modification is of at least one of the plurality of musical keys to change the musical sound produced by at least one of the musical keys, with a further modification effected by a plurality of relatively rapid hits of the one key of the plurality of QWERTY keys.

10. A method as claimed in claim 9, wherein the modification is of the at least one music function key, the at least one music function key having functionality to produce the musical effect.

11. A method as claimed in claim 10, wherein the musical effect is selected from the group consisting of: trill, tremolo, and vibrato.

12. A method as claimed in claim 11, wherein the modification is selected from the group consisting of: pitch and speed.

13. A method as claimed in claim 10, wherein the modification is only affective while the at least one QWERTY key is pressed after the at least one music function key has been pressed.

14. A method as claimed in claim 9, wherein the change is to that of a first musical instrument.

15. A method as claimed in claim 9, where the plurality of relatively rapid hits is two in number.

16. A method as claimed in claim 15, wherein the further modification is to change the musical sound produced by the at least one of the musical keys to that of a second musical instrument.

17. A method as claimed in claim 9, wherein the modification is of both of the at least one music function key and at least one of the plurality of musical keys, the at least one music function key having functionality to produce the musical effect.

18. A method as claimed in claim 17, wherein the musical effect is selected from the group consisting of: trill, tremolo, and vibrato.

19. A method as claimed in claim 18, wherein the modification is selected from the group consisting of: pitch and speed.

20. A method as claimed in claim 18, wherein the modification is only effective while the at least one QWERTY key is pressed after the at least one music function key has been pressed.

21. A method as claimed in claim 17, wherein the modification is of the musical sound produced upon activation of at least one of the plurality of musical keys.

22. A method as claimed in claim 21, wherein the change is to that of a first musical instrument.

23. A method as claimed in claim 21, wherein a further modification can be effected by a plurality of relatively rapid hits of the one key of the plurality of QWERTY keys.

24. A method as claimed in claim 23, where the plurality of relatively rapid hits is two in number.

25. A method as claimed in claim 24, wherein the further modification is to change the musical sound produced by the at least one of the musical keys to that of a second musical instrument.

26. A computer useable medium comprising a computer program code that is configured to cause a processor to execute a method for use of a QWERTY keyboard to modify the sound produced by an operation of a musical keyboard, the QWERTY keyboard being associated with the musical keyboard, the musical keyboard having at least one music function key for producing a musical effect, the method including: upon the pressing of at least one of the plurality of musical keys of the musical keyboard or at least one music function key, pressing at least once a desired one of the QWERTY keys to modify the musical sound produced, wherein the modification is of at least one of the plurality of musical keys to change the musical sound produced by at least one of the musical keys, with a further modification effected by a plurality of relatively rapid hits of the one key of the plurality of QWERTY keys.

* * * * *